US008922325B2

(12) United States Patent
Shibuya et al.

(10) Patent No.: US 8,922,325 B2
(45) Date of Patent: Dec. 30, 2014

(54) COIL COMPONENT INCLUDING MAGNETIC BODY

(75) Inventors: Tomonori Shibuya, Mie (JP); Tsunetsugu Imanishi, Mie (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/391,911

(22) PCT Filed: Sep. 2, 2010

(86) PCT No.: PCT/JP2010/005408

§ 371 (c)(1), (2), (4) Date: Feb. 23, 2012

(87) PCT Pub. No.: WO2011/027559

PCT Pub. Date: Mar. 10, 2011

(65) Prior Publication Data

US 2012/0146759 A1 Jun. 14, 2012

(30) Foreign Application Priority Data

Sep. 3, 2009 (JP) ..... 2009-203247

(51) Int. Cl.

| | |
|---|---|
| ***H01F 27/24*** | (2006.01) |
| ***H01F 27/255*** | (2006.01) |
| ***H01F 17/04*** | (2006.01) |
| ***H01F 41/02*** | (2006.01) |

(52) U.S. Cl.

CPC ..... *H01F 27/255* (2013.01); *H01F 17/043* (2013.01); *H01F 41/0246* (2013.01)

USPC ..... 336/233; 336/212; 336/214

(58) Field of Classification Search

USPC ..... 336/221, 233, 212, 214, 184, 215

See application file for complete search history.

(56) References Cited

U.S. PATENT DOCUMENTS

| | | | | |
|---|---|---|---|---|
| 4,325,080 A * | 4/1982 | Satoh | ..... | 386/224 |
| 5,731,666 A * | 3/1998 | Folker et al. | ..... | 315/276 |

(Continued)

FOREIGN PATENT DOCUMENTS

| | | |
|---|---|---|
| JP | S61144626 U | 9/1986 |
| JP | 04-315408 A | 11/1992 |

(Continued)

OTHER PUBLICATIONS

International Application Serial No. PCT/JP2010/005408, International Search Report mailed Nov. 30, 2010, 4 pgs.

*Primary Examiner* — Mangtin Lian

(74) *Attorney, Agent, or Firm* — RatnerPrestia

(57) ABSTRACT

A coil component comprising a first split magnetic core and a second split magnetic core, each having an outer core leg, an inner core leg and a back yoke connecting the outer core leg and the inner core leg, and a coil block mounted to the inner core leg, wherein the outer core leg has a sectional area smaller than a sectional area of the inner core leg, a density of magnetic body in the outer core leg is different from a density of the magnetic body in any of the inner core leg and the back yoke, and the first split magnetic core and the second split magnetic core are butted against each other to form a magnetic core of a closed magnetic circuit.

16 Claims, 18 Drawing Sheets

(56) References Cited

U.S. PATENT DOCUMENTS

| | | | | |
|---|---|---|---|---|
| 5,748,013 | A * | 5/1998 | Beauclair et al. | 336/233 |
| 6,317,021 | B1 * | 11/2001 | Jansen | 336/155 |
| 6,980,077 | B1 * | 12/2005 | Chandrasekaran et al. | 336/212 |
| 7,427,909 | B2 * | 9/2008 | Ono et al. | 336/90 |
| 7,498,922 | B2 * | 3/2009 | Flanders et al. | 336/220 |
| 2004/0046626 | A1 | 3/2004 | Nakata | |
| 2009/0002117 | A1 * | 1/2009 | Kawarai | 336/233 |

FOREIGN PATENT DOCUMENTS

| | | | |
|---|---|---|---|
| JP | 04315408 | A | 11/1992 |
| JP | 2002134330 | A | 5/2002 |
| JP | 2003-068550 | A | 3/2003 |
| JP | 2003068550 | A | 3/2003 |
| JP | 2003-168610 | A | 6/2003 |
| JP | 2003217958 | A | 7/2003 |
| JP | 2009-033051 | A | 2/2009 |
| JP | 2009033051 | A | 2/2009 |

* cited by examiner

FIG. 6

| Forming Pressure (MPa) | Density (g/cm3) | | | Magnetic Properties – 25 Square E Core (100mT/100kHz) | | Usable Die Life (x 10k Shots) | | |
|---|---|---|---|---|---|---|---|---|
| | Outer Core Leg | Back Yoke | Inner Core Leg | Initial Permeability μi | Core Loss (kW/m3) | Outer Core Leg | Back Yoke | Inner Core Leg |
| 400 | 6.35 | 6.34 | 6.36 | 46 | 1013 | 38 | 76 | 78 |
| 600 | 6.65 | 6.64 | 6.65 | 70 | 870 | 32 | 73 | 77 |
| 800 | 6.84 | 6.86 | 6.85 | 85 | 830 | 10 | 68 | 75 |
| 1000 | 7.03 | 7.03 | 7.03 | 93 | 746 | 6 | 65 | 72 |
| 1200 | 7.08 | 7.07 | 7.08 | 101 | 695 | 3 | 60 | 69 |
| 1400 | 7.13 | 7.14 | 7.13 | 108 | 680 | 1 | 58 | 66 |
| 1600 | 7.20 | 7.18 | 7.19 | 114 | 669 | 0.1 | 51 | 58 |
| 1800 | 7.23 | 7.22 | 7.23 | 120 | 650 | 0 | 26 | 32 |
| 2000 | 7.26 | 7.26 | 7.27 | 125 | 632 | 0 | 8 | 18 |

FIG. 7

| Forming Pressure (MPa) | Density (g/cm3) | | | Magnetic Properties – 25 Square E Core (100mT/100kHz) | | Usable Die Life (x 10k Shots) | | |
|---|---|---|---|---|---|---|---|---|
| | Outer Core Leg | Back Yoke | Inner Core Leg | Initial Permeability μi | Core Loss (kW/m3) | Outer Core Leg | Back Yoke | Inner Core Leg |
| 600 | 6.65 | — | — | 103 (101) | 692 (695) | 32(3) | — | — |
| 1600 | — | 7.18 | — | | | — | 51(60) | — |
| 1600 | — | — | 7.19 | | | — | — | 58(69) |

(Note: Values in parentheses are recorded when the individual portions are formed with a uniform pressure of 1,200Mpa.)

FIG. 8

| Forming Pressure (MPa) | Density (g/cm3) | | | Magnetic Properties – 25 Square E Core (100mT/100kHz) | | Usable Die Life (x 10k Shots) | | |
|---|---|---|---|---|---|---|---|---|
| | Outer Core Leg | Back Yoke | Inner Core Leg | Initial Permeability μi | Core Loss (kW/m3) | Outer Core Leg | Back Yoke | Inner Core Leg |
| 1000 | 7.03 | — | — | 105 (101) | 685 (695) | 6(3) | — | — |
| 1400 | — | 7.13 | — | | | — | 58(60) | — |
| 1400 | — | — | 7.13 | | | — | — | 66(69) |

(Note: Values in parentheses are recorded when the individual portions are formed with a uniform pressure of 1,200Mpa.)

FIG. 10

| Forming Pressure (MPa) | Density (g/cm3) | | | Magnetic Properties – 25 Square E Core (100mT/100kHz) | | Usable Die Life (x 10k Shots) | | |
|---|---|---|---|---|---|---|---|---|
| | Outer Core Leg | Back Yoke | Inner Core Leg | Initial Permeability μi | Core Loss (kW/m3) | Outer Core Leg | Back Yoke | Inner Core Leg |
| 400 | 5.28 | 5.27 | 5.28 | 22 | 724 | 39 | 70 | 73 |
| 600 | 5.38 | 5.39 | 5.39 | 29 | 675 | 29 | 68 | 70 |
| 800 | 5.54 | 5.54 | 5.55 | 35 | 635 | 8 | 62 | 66 |
| 1000 | 5.62 | 5.62 | 5.61 | 41 | 612 | 5 | 59 | 62 |
| 1200 | 5.68 | 5.68 | 5.68 | 45 | 580 | 2 | 56 | 60 |
| 1400 | 5.75 | 5.76 | 5.74 | 49 | 557 | 1 | 53 | 58 |
| 1600 | 5.8 | 5.79 | 5.80 | 53 | 538 | 0.1 | 48 | 55 |
| 1800 | 5.86 | 5.85 | 5.84 | 56 | 524 | 0 | 24 | 29 |
| 2000 | 5.87 | 5.89 | 5.88 | 58 | 500 | 0 | 6 | 14 |

FIG. 11

| Forming Pressure (MPa) | Density (g/cm3) | | | Magnetic Properties – 25 Square E Core (100mT/100kHz) | | Usable Die Life (x 10k Shots) | | |
|---|---|---|---|---|---|---|---|---|
| | Outer Core Leg | Back Yoke | Inner Core Leg | Initial Permeability μi | Core Loss (kW/m3) | Outer Core Leg | Back Yoke | Inner Core Leg |
| 600 | 5.39 | — | — | 46 (45) | 564 (580) | 29(2) | — | — |
| 1600 | — | 5.80 | — | | | — | 48(56) | — |
| 1600 | — | — | 5.80 | | | — | — | 55(60) |

(Note: Values in parentheses are recorded when the individual portions are formed with a uniform pressure of 1,200Mpa.)

FIG. 12

| Forming Pressure (MPa) | Density (g/cm3) | | | Magnetic Properties – 25 Square E Core (100mT/100kHz) | | Usable Die Life (x 10k Shots) | | |
|---|---|---|---|---|---|---|---|---|
| | Outer Core Leg | Back Yoke | Inner Core Leg | Initial Permeability μi | Core Loss (kW/m3) | Outer Core Leg | Back Yoke | Inner Core Leg |
| 1000 | 5.61 | — | — | 48 (45) | 560 (580) | 5(2) | — | — |
| 1400 | — | 5.74 | — | | | — | 53(56) | — |
| 1400 | — | — | 5.74 | | | — | — | 58(60) |

(Note: Values in parentheses are recorded when the individual portions are formed with a uniform pressure of 1,200Mpa.)

COIL COMPONENT INCLUDING MAGNETIC BODY

TECHNICAL FIELD

The present invention relates to a coil component used for various electronic apparatuses, and a method of manufacturing the same.

BACKGROUND ART

Description is provided of a conventional coil component with reference to the accompanying drawings. FIG. 16 is a sectional view of a conventional coil component. Coil component 7 comprises first split magnetic core 4 and second split magnetic core 5, each having outer core legs 1, inner core leg 2 and back yoke 3 connecting outer core legs 1 and inner core leg 2, wherein first split magnetic core 4 and second split magnetic core 5 are butted against each other with coil block 6 placed on inner core legs 2. FIG. 17 is a sectional view of the conventional coil component in a configuration showing first split magnetic core 4 and second split magnetic core 5 butted against each other.

First split magnetic core 4 and second split magnetic core 5 are produced by pressure forming magnetic powder with a high pressure exceeding 700 MPa to 1,000 MPa in some cases, by using a powder forming die. In the process of pressure forming, outer core legs 1, inner core legs 2 and back yokes 3 are formed nearly uniformly in their densities by applying generally equal pressure in order to ensure the mechanical strength and magnetic property of first split magnetic core 4 and second split magnetic core 5.

In the case of the conventional coil component, it has been necessary to place many constraints on the shape of the forming die including the need to design outer core legs 1 and inner core legs 2 to have generally similar dimensions and sectional areas for the purpose of forming the individual sections with generally the same pressure when consideration is given to avoid the forming die from being damaged or buckled and to keep its durability and usable life. Patent Literature 1 below, for instance, is one of the technical literatures of the prior art known to be relevant.

According to the intrinsic concept of magnetic circuit design, however, it is rather appropriate for outer core legs 1 and back yokes 3 to have sectional areas smaller than that of inner core legs 2. This is because the magnetic flux $\phi$ generated by an electric current flowing in coil block 6 is divided into two flows ($\phi 1$ and $\phi 2$) toward outer core legs 1 at both sides from inner core leg 2 through back yoke 3, as shown in FIG. 17.

When attempting to reduce the sectional area of outer core legs 1, for instance by decreasing a thickness of outer core legs 1 in the conventional coil component, it becomes necessary to apply a forming die having a smaller sectional area in certain portions, e.g., thinner portions, as compared with other portions in the process of forming first split magnetic core 4 and second split magnetic core 5.

However, there have been some problems associated with the forming die having thin areas such that it is liable to get damaged, buckled down or worn out severely due to the mechanically weak elements, thereby requiring frequent maintenance and posing a variety of constraints when determining a shape of the forming die.

It thus becomes necessary after all to make outer core legs 1 and inner core leg 2 to have generally the same dimensions and sectional area, as shown in FIG. 16 in order to avoid such constraints imposed on the forming die. This results in outer core legs 1 to have a useless volume beyond what is needed, thereby giving rise to a problem that it becomes a factor of impeding downsizing of first split magnetic core 4 and second split magnetic core 5, or coil component 7.

CITATION LIST

Patent Literature

PTL 1: Unexamined Japanese Patent No. 2002-134330

SUMMARY OF INVENTION

The present invention addresses the problems discussed above and provides a coil component having a magnetic core, which achieves a cost reduction by avoiding a forming die from being damaged or buckled and prolonging its durable life while reducing constraints on configurations of the forming die and coil in addition to realizing a downsizing.

The present invention discloses a coil component comprising a first split magnetic core and a second split magnetic core, each having an outer core leg, an inner core leg and a back yoke connecting the outer core leg and the inner core leg, and a coil block mounted to the inner core leg, wherein the outer core leg has a sectional area smaller than a sectional area of the inner core leg, a density of magnetic body in the outer core leg is different from a density of the magnetic body in any of the inner core leg and the back yoke, and the first split magnetic core and the second split magnetic core are butted against each other to form a magnetic core of a closed magnetic circuit.

BRIEF DESCRIPTION OF DRAWINGS

FIG. 6 is a tabulation of actual measurement values showing densities of the magnetic body in individual portions, magnetic properties and useable lives of individual parts of forming die in relation to forming pressures according to the exemplary embodiment of this invention;

FIG. 7 is another tabulation of actual measurement values when a pressure of different value is used to form each of the outer core leg, the inner core leg and the back yoke in an attempt to obtain an initial permeability $\mu i$ of about 100 and a core-loss value of about 690 kW/m$^3$ after the first split magnetic core and the second split magnetic core are butted together;

FIG. 8 is still another tabulation of actual measurement values taken with different conditions set to approximate and obtain similar measurement values (i.e., initial permeability μi of 101 and core loss of 695 kW/m$^3$);

FIG. 10 is a tabulation of actual measurement values showing densities of the magnetic body in individual portions, magnetic properties and useable lives of individual parts of the forming die in relation to forming pressures when the individual portions are uniformly formed by using a sendust-base magnetic material according to the exemplary embodiment of this invention;

FIG. 11 is another tabulation of actual measurement values when a pressure of different value is used to form each of the outer core leg, the inner core leg and the back yoke in an attempt to obtain an initial permeability μi of about 45 and a core-loss value of about 580 kW/m$^3$ after the first split magnetic core and the second split magnetic core made of the sendust-base magnetic material are butted together;

FIG. 12 is still another tabulation of actual measurement values taken with different conditions set to approximate and obtain similar measurement values (i.e., initial permeability μi of 45 and core loss of 580 kW/m$^3$);

BEST MODE FOR CARRYING OUT THE INVENTION

Description is provided hereinafter of exemplary embodiments of the present invention with reference to the accompanying drawings.

Exemplary Embodiments

Figure 1:
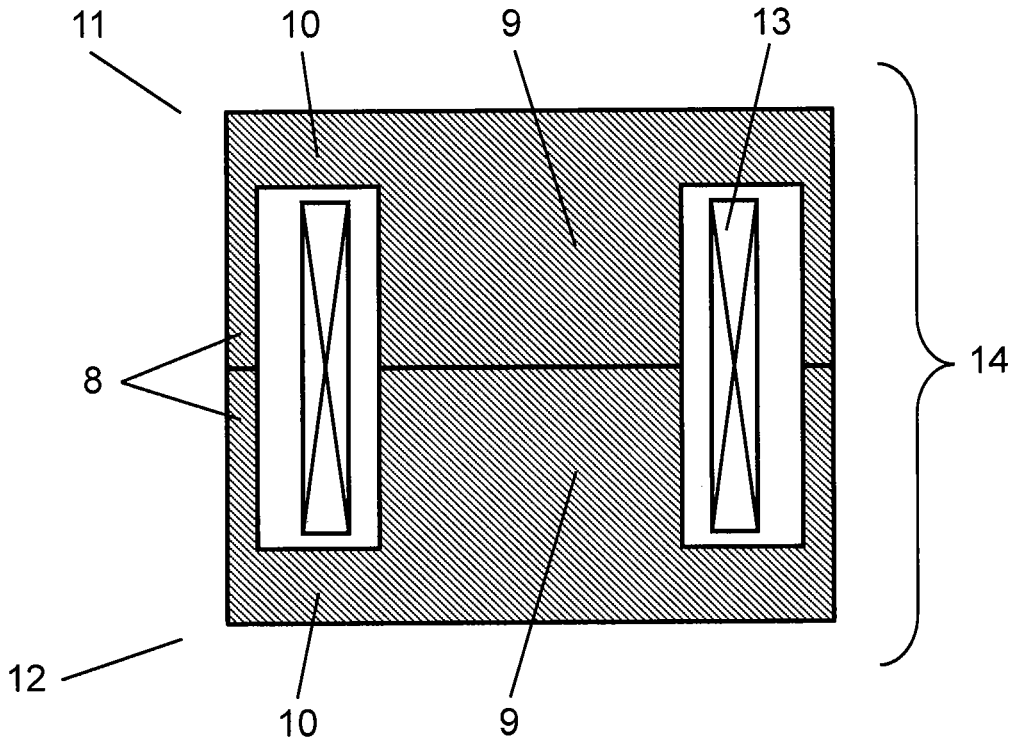
FIG. 1 is a sectional view showing an example of a coil component according to one exemplary embodiment of the present invention.

FIG. 1 is a sectional view showing one example of a coil component according to the exemplary embodiment of this invention. As shown in FIG. 1, coil component 14 comprises first split magnetic core 11 and second split magnetic core 12, each having outer core legs 8, inner core leg 9 and back yoke 10 connecting outer core legs 8 and inner core leg 9.

Coil component 14 has a closed magnetic circuit configured with first split magnetic core 11 and second split magnetic core 12 that are butted against each other after coil block 13 is mounted by having inner core leg 9 penetrate through it. First split magnetic core 11 and second split magnetic core 12 are formed by using a magnetic body. Here, the magnetic body is produced by a process of pressure forming magnetic powder containing magnetic metal powder and a resin.

Figure 2:
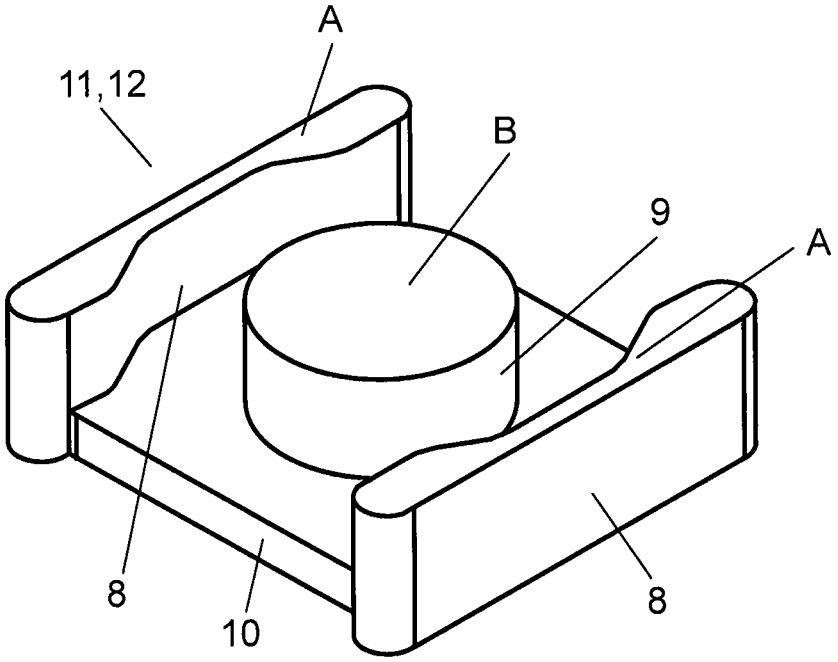
FIG. 2 is a perspective view showing an example of one of a first split magnetic core and a second split magnetic core composing the coil component according to the exemplary embodiment of this invention.

FIG. 2 is a perspective view showing an example of one of the first split magnetic core and the second split magnetic core composing the coil component according to the exemplary embodiment of this invention. Coil component 14 is so formed that sectional area A of each outer core leg 8 is smaller than sectional area B of inner core leg 9, as shown in FIG. 2. In addition, the magnetic body in outer core legs 8 is formed lower in density as compared with those of the magnetic body in inner core leg 9 and back yoke 10.

First split magnetic core 11 and second split magnetic core 12 are constructed by using a metal die and individual portions formed in a manner that a lower pressure is applied to a portion subjected to a part of the forming die having a smaller sectional area and a higher pressure than that of the smaller sectional area is applied to a portion subjected to a part of the die having a larger sectional area. It becomes possible in this manner to adjust the above-discussed densities of the magnetic body for the individual portions.

In the example of FIG. 1 and FIG. 2, the magnetic body in outer core legs 8, which are the portions of smaller sectional area when first split magnetic core 11 and second split magnetic core 12 are viewed from their butting direction, are formed into relatively low density, and the magnetic body in inner core leg 9 and back yoke 10, which are the portions of larger sectional areas are formed into relatively high density.

Accordingly, this makes the sectional areas of the individual portions freely changeable as needed, such as those of inner core leg 9 and outer core legs 8 in any of first split magnetic core 11 and second split magnetic core 12. It is especially possible to reduce the sectional areas and volumes of back yoke 10 and outer core legs 8, since back yoke 10 has a less effect of its permeability, core loss, etc. on the device's magnetic property because of a small amount of magnetic flux it carries, and outer core legs 8 have a lesser effect due to even a smaller amount of magnetic flux they carry as compared to a large effect of inner core leg 9, which receives concentration of these magnetic fluxes. This can provide coil component 14 of the intended characteristics while minimizing volumes of first split magnetic core 11 and second split magnetic core 12. In other words, it can achieve a downsizing of coil component 14.

In addition, coil component 14 has generally uniform distribution in density of the magnetic body in each individual portion of outer core legs 8, inner core leg 9 and back yoke 10. Since this prevents the magnetic flux from concentrating locally into a certain area within any of the individual portions, it makes determination of local dimensions unnecessary for the purpose of avoiding concentration of the magnetic flux, thereby improving a degree of easiness in the design of coil component 14 when reducing the overall dimensions of coil component 14 evenly.

In the process of forming coil component 14, a higher pressure is applied to a part of the forming die having a larger sectional area where damages, buckling and wearing are not likely to progress easily whereas the pressure is reduced for other parts of the forming die having a smaller sectional area where wear-out is likely to occur quickly, so as to retard the progress of damages, buckling and wearing. This can prolong the usable life of the forming die since it makes the life of the forming die dependent on the part having the larger sectional area where wearing is unlikely to progress while also maintaining coordination with the magnetic property. This can also achieve a reduction of the cost related to production of the forming die.

What has been shown above is an example in which outer core leg 8 is formed lower in the density of the magnetic body than any of the corresponding densities of inner core leg 9 and back yoke 10, and that this embodiment should not be construed as restricting the scope of the present invention. The densities of the individual portions and their relationship with the dimensions and sectional areas can be modified as appropriate according to the shape of the forming die for making first split magnetic core 11 and second split magnetic core 12, the characteristics and the like required for coil component 14.

It may be appropriate, for instance, to increase the density of the magnetic body of outer core legs 8 to be higher than those of inner core leg 9 and back yoke 10 and to design dimensions of the forming die accordingly (e.g., to make the sectional area of outer core legs 8 larger than that of inner core leg 9) when coil component 14 is designed with the primary importance placed on prevention of the magnetic flux from leaking to the outside of coil component 14 rather than regarding magnetic saturation as a problem.

Particularly, in the case of forming the magnetic core of a shape such as that shown in FIG. 1 and FIG. 2 to compose a desired closed magnetic circuit rather than a simple magnetic core of a rod-like or toroidal shape, a difference in the degree of wearing becomes significant as it depends on sizes of the individual parts of the die when forming with a high pressure exceeding 700 MPa up to 1,000 MPa in some cases as compared to a low pressure of about 100 Mpa.

Since coil component 14 of this exemplary embodiment allows various dimensions and sectional areas freely selectable for the individual parts of the forming die by using different forming pressures applied to the individual parts of the die, it can prolong the useable life of the die while also realizing the magnetic core of any shape capable of exhibiting the desirable characteristics.

In this exemplary embodiment, it becomes possible to provide the magnetic body with wide variations in density even after the formation of it by way of compressing it with any pressures corresponding to various parts of the forming die at a very high level of pressure in the absolute value, thereby achieving the capability of controlling the density values flexibly and precisely.

Furthermore, first split magnetic core 11 and second split magnetic core 12 shown in FIG. 1 and FIG. 2 are formed into generally the same shape, but not provided with any magnetic gap derived dimensionally from a geometrical space. In this exemplary embodiment, however, coil component 14 can be so formed as to be equivalent to such a configuration as to have a slight spatial gap in the magnetic circuit since the density, or the permeability, of the magnetic body can be varied in any given portion as mentioned above.

As illustrated, it is not necessary according to coil component 14 of this exemplary embodiment to produce a magnetic core having any gap (not shown) formed by varying the dimensions for only the purpose of forming the magnetic gap, and it can hence achieve high productivity of first split magnetic core 11 and second split magnetic core 12.

In addition, since the above embodiment eliminates the need to form the magnetic gap dimensionally in the process of producing coil component 14, it becomes unnecessary to control dimensions of the gap or to provide a spacer to maintain the gap. Accordingly, this embodiment can ensure stable magnetic characteristics in addition to achieving a reduction in the number of components as well as the number of manufacturing steps.

When consideration is made in the aspects of both leakage of magnetic flux to the outside and magnetic saturation within the magnetic circuit in the case of coil component 14 having outer core legs 8 of the magnetic body of lower density and lower magnetic permeability than those of inner core leg 9, it so occurs that the magnetic flux leaks from the entire outer core legs 8, which virtually act as magnetic gaps. On the other hand, inner core leg 9 having the magnetic body of relatively high density and high permeability is liable to magnetic saturation since it is away from the virtual magnetic gaps and takes concentration of the magnetic flux. It is from this aspect that inner core leg 9 is formed to be the magnetic body of high density to keep a high permeability and to have a sectional area larger than that of outer core legs 8, so as to provide coil component 14 with stable characteristics as noted previously.

Figure 3:
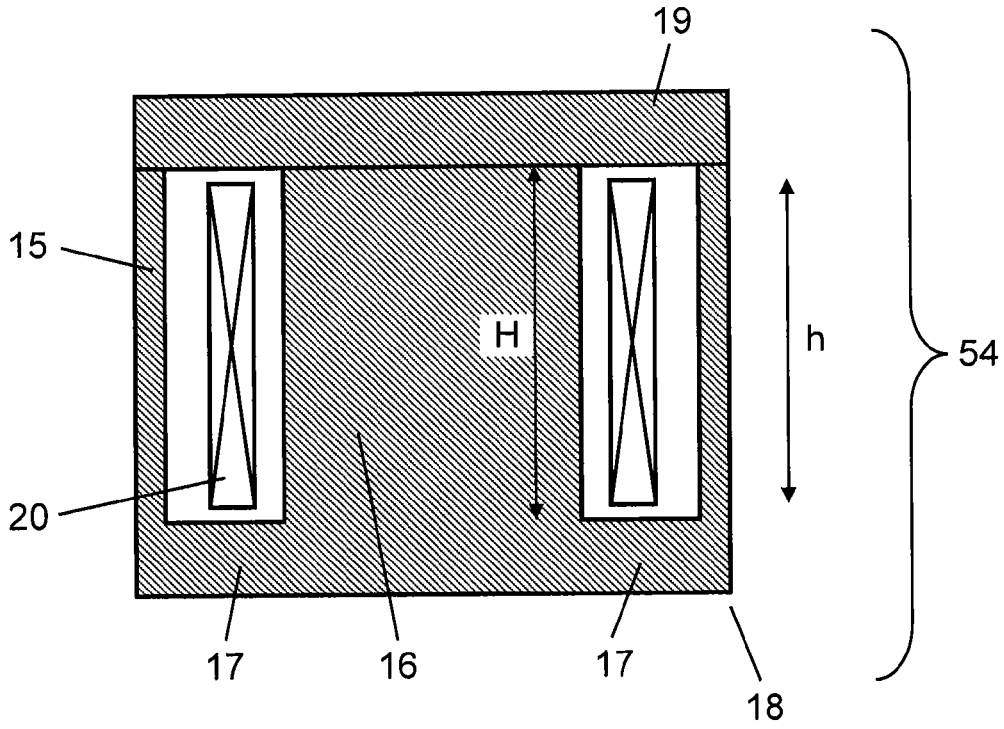
FIG. 3 is a sectional view showing another example of the coil component according to the exemplary embodiment of this invention.

While coil component 14 shown in FIG. 1 and FIG. 2 is the example having the closed magnetic circuit formed by butting together first split magnetic core 11 and second split magnetic core 12 of generally the same shape, there can be another example of coil component, which will be described hereinafter. FIG. 3 is a sectional view illustrating another example of the coil component according to the exemplary embodiment of this invention.

In coil component 54 shown in FIG. 3, a closed magnetic circuit is configured by butting first split magnetic core 18 having outer core legs 15, inner core leg 16 and back yoke 17 connecting inner core leg 16 and outer core legs 15 against second split magnetic core 19 of either a rod-like or plate-like shape. It is also in coil component 54 that the magnetic body in outer core legs 15 is made lower in density as compared with those of the magnetic body in inner core leg 16 and back yoke 17.

In coil component 54, second split magnetic core 19 is made to have a higher permeability or density of the magnetic body than that of outer core legs 15. Accordingly, there exist the magnetic body of low permeability or low density in areas (i.e., outer core legs 15) facing the outer side of coil block 20. Although leakage of the magnetic flux becomes the largest in these areas, distribution of the flux leakage becomes generally uniform since these areas of outer core legs 15 are generally uniformly made to be low in the permeability or the density throughout, and the flux leakage takes place over these areas of low permeability instead of certain local sections such as gaps. This brings down an adverse influence such as heat caused by the flux leakage because the areas subjected to the influence in coil component 54 are also spread widely.

In addition, the areas of outer core legs 15 where first split magnetic core 18 is butted against second split magnetic core 19 are in such a positional relation comparatively away in distance as seen from coil block 20. This structure can further decrease the adverse influence such as heat exerted on coil block 20 due to the flux leakage emerging from the butted area between outer core legs 15 and second split magnetic core 19. It can also reduce variations in degree of the influence caused by the flux leakage even if coil block 20 shifts its position along an axis of inner core leg 16.

As discussed above, it becomes possible to suppress product variations by virtue of the structure of coil component 54 shown in FIG. 3. Because coil block 20 becomes not vulnerable to the influence of the magnetic flux leakage from outer core legs 15 confronting it, it is also possible to reduce the spacing distance between coil block 20 and outer core legs 15, and to help reduce the overall size of coil component 54 in this respect.

Figure 4:
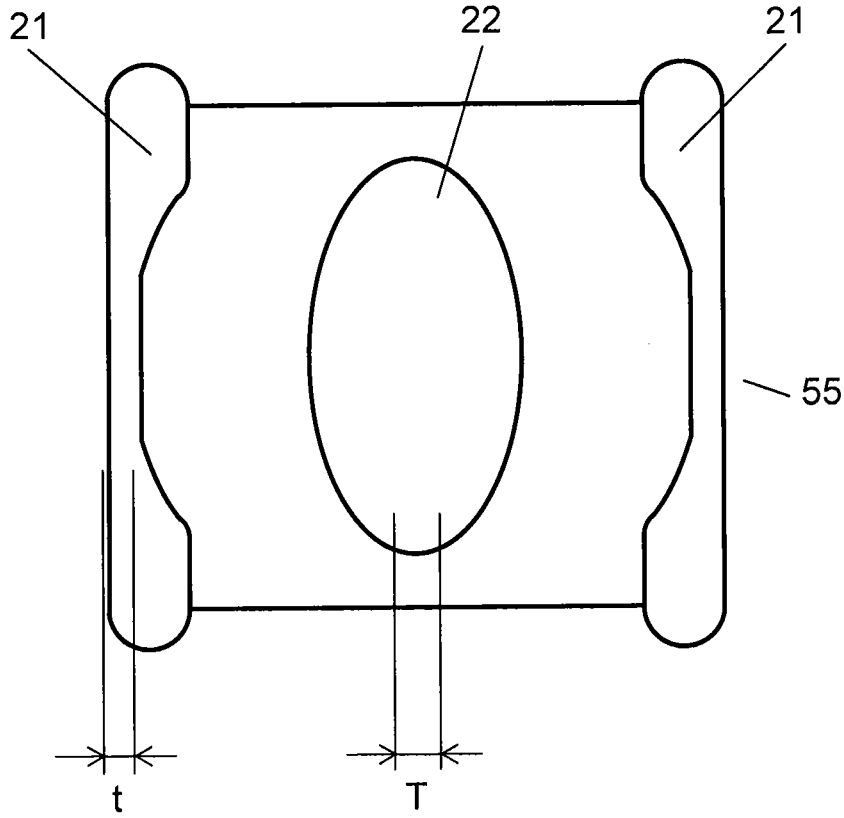
FIG. 4 is a schematic drawing illustrating a relation between densities and dimensions of magnetic body according to the exemplary embodiment of this invention.

FIG. 4 is a schematic drawing illustrating a relation between densities and dimensions of a magnetic body according to the exemplary embodiment of this invention. In the case of split magnetic core 55 of a unique configuration shown in FIG. 4, densities of the magnetic body at individual portions of outer core legs 21 and inner core leg 22 can be set according to a relation of dimensions corresponding to the thinnest portions among individual outer core legs 21 and inner core leg 22. In other words, the density of the magnetic body is reduced in an area of the portion having the smallest thickness as opposed to the other portions.

In the example of split magnetic core 55, a portion of the smallest thickness (thickness t) of outer core legs 21 having a smaller sectional area is formed thinner than a portion of the smallest thickness (show as thickness T for convenience sake in the drawing) of inner core leg 22. In the example shown in FIG. 4, it is not easy to specify a dimension of the thickness T, since inner core leg 22 has a cross section of circular shape or generally oval shape when viewed from the upper side. It is practically acceptable, however, that the density of the magnetic body in inner core leg 22 is increased larger than that of outer core legs 21 if there is no portion in inner core leg 22 that is thinner than the smallest thickness of outer core legs 21.

In other words, a pressure used during the forming process is reduced for an area of the forming die corresponding to the portion of the smallest thickness to maintain evenness in the degree of wearing of the forming die as a whole, since the area corresponding to the smallest wall portion is liable to wear out most quickly. It is thus reasonable to adjust the forming pressure according to the relative wall thickness rather than just a relation of the sectional areas.

Figure 5A:
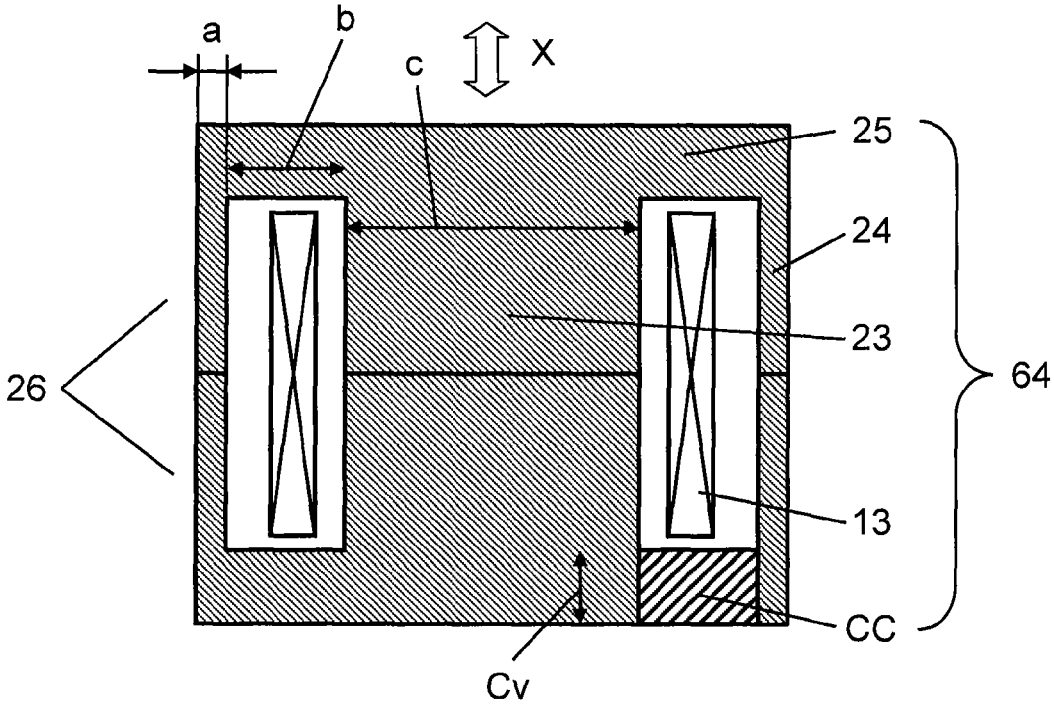
FIG. 5A is a sectional view of the coil component illustrating the relation between densities and sectional areas of the magnetic body according to the exemplary embodiment of this invention.
Figure 5B:
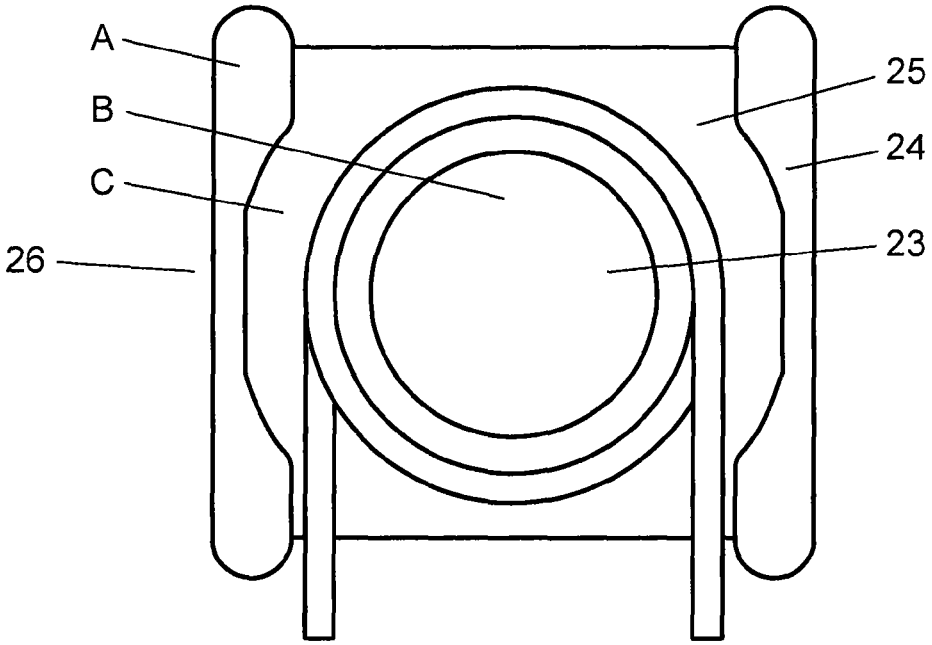
FIG. 5B is a top view of the coil component illustrating the relation between densities and sectional areas of the magnetic body according to the exemplary embodiment of this invention.

Here, description is provided further of the relation between density and sectional area of the magnetic body for each individual portion of the coil component according to this exemplary embodiment of the invention. FIG. 5A is a sectional view of the coil component, illustrating the relation between densities and sectional areas of the magnetic body according to this exemplary embodiment of the invention, and FIG. 5B is a top view of the same component. In the embodiment shown in FIG. 5A, a pair of split magnetic cores 26 are butted against each other to form coil component 64. Normally, each unit of split magnetic cores 26 is formed by applying a pressure in the X-direction corresponding to the axis of inner core leg 23.

Certain areas of the forming die are subject to damages, buckling and excessive wear when they correspond to magnetic core portions of such dimensions that are thick in the direction of pressurizing stroke (X-direction) but thin in the cross-sectional direction perpendicular to the pressurizing direction outer core legs 24. For this reason, the density of the magnetic body is decreased comparatively for outer core legs 24. On the other hand, the density of the magnetic body for inner core leg 23 is increased comparatively since it is the portion having a large dimension in the cross-sectional direction perpendicular to the direction of pressurizing stroke.

Back yoke 25 between inner core leg 23 and outer core legs 24 has a dimension quite larger than that of outer core legs 24 in the direction perpendicular to the direction of pressurizing stroke since it is located around inner core leg 23 in the area corresponding to where coil block 13 is placed. In other words, there are relations of $a < b$ and $a < c$ when dimensions of outer core leg 24, inner core leg 23 and back yoke 25 in the direction perpendicular to the direction of pressurizing stroke are denoted as a, b and c respectively.

Moreover, there are relations of $A < B$ and $A < C$ when any of sectional area and surface area of each of the portions of split magnetic core 26 corresponding to outer core leg 24, inner core leg 23 and back yoke 25 in the direction perpendicular to the direction of pressurizing stroke are denoted as A, B and C respectively, as viewed from the pressurizing direction shown in FIG. 5B.

On the other hand, back yoke 25 is located around inner core leg 23 as described previously, and there can be any case among the relations of $B < C$ $B = C$ and $B < C$ between their surface areas. The sectional area of outer core legs 24 is therefore the one that needs to be made the smallest to satisfy $A < B$ and $A < C$ in relation to the densities of the magnetic body in outer core legs 24, inner core leg 23 and back yoke 25.

Coil component 64 shown in FIG. 5A can be designed as to be a well-balanced magnetic circuit by satisfying these relations. In the example of coil component 64, outer core legs 24 not having any apparent magnetic gap are assigned as to be the portions of low permeability, and inner core leg 23 and back yoke 25 are formed to have comparatively low magnetic resistances of generally an equal value whereas outer core legs 24 are formed to have a comparatively high resistance. According to this structure, when coil component 64 is composed with split magnetic cores 26 butted against each other, it allows the magnetic flux to leak evenly throughout outer core legs 24 while preventing the magnetic flux leakage from occurring at a certain area such as a magnetic gap formed by a spacing, for instance.

As a result, this structure can avoid sharp influences to the performances of other neighboring electronic components and the like attributed to their positional relations when coil component 64 is mounted. It can also reduce the effects of heat and the like exerted on coil block 13 due to the flux leakage emerging from outer core legs 24.

While description has been given hitherto of the features in the viewpoint related to the magnetic properties, there is also another aspect related to the dimensions in the light of sliming down an overall height of coil component 14, that it is possible to reduce height dimension of Cv (FIG. 5A) by increasing the density of the magnetic body in back yoke 25 so as to decrease the height dimension of split magnetic core 26. In view of the mechanical strength, on the other hand, the magnetic body in the mass, or area CC (FIG. 5A), of back yoke 25 is formed uniform in the distribution of density, which also achieves uniformity in the mechanical strength within the area CC. Since this prevents any given spot from becoming weak inside back yoke 25, which is prone to receiving a mechanical stress, it can improve the strength of split magnetic core 26 as an integral unit.

Various properties have been actually measures on first split magnetic core 11 and second split magnetic core 12 shown in FIG. 1 and FIG. 2 among those coil components discussed above, the results of which will be described now. FIG. 6 is a tabulation of actual measurement values showing densities of the magnetic body in individual portions, magnetic properties and useable lives of the individual parts of the forming die in relation to forming pressures according to this exemplary embodiment of the invention.

Tabulated in FIG. 6 are the actual values taken on first split magnetic core 11 and second split magnetic core 12 of the shape shown in FIG. 1 and FIG. 2, of which samples are made of a permalloy-base magnetic material, and formed uniformly throughout all corners into a size having an upper surface of 25 mm square and a height dimension of 7.5 mm. The usable life of the forming die generally shortens as the height dimension is increased, but the usable life of the die generally becomes prolonged on the contrary when the height dimension is decreased. The example used here has area A of about 52 $mm^2$ for both outer core legs 8, area B of about 113 $mm^2$ for inner core leg 9 and an area of about 300 $mm^2$ for back yoke 10 when viewed from the upper side in FIG. 2.

The criteria used here for determination of the life of the forming die include an occurrence of any damage or buckling and recognition of wear having exceeded a predetermined limit. The measurement values tabulated here have been taken on magnetic cores of the finished condition in which all samples are completed with resin impregnation, and that no crack etc. have been observed in boundaries between any of outer core legs 8, inner core leg 9 and back yoke 10 even when there are differences in the densities among them.

In FIG. 6, densities of the magnetic body of 7.08, 7.07 and 7.08 g/$cm^3$ are recorded for the individual portions of outer core legs 8, inner core leg 9 and back yoke 10 respectively when the forming pressure is set to 1,200 Mpa, for instance. An initial permeability μi of 101 and a core loss of 695 kW/$m^3$ are taken after first split magnetic core 11 and second split magnetic core 12 are assembled. With regard to the usable life of the forming die, a part corresponding to outer core leg 8 shows about 30,000 shots, which is an extremely small number as compared with 690,000 shots and 600,000 shots for inner core leg 9 and back yoke 10 respectively. As discussed previously, this is because the parts of the forming die corresponding to outer core legs 8 having the smaller sectional area in the direction perpendicular to the direction of stroke tend to exhibit their vulnerability if the same high pressure as the other portions is applied when forming outer core legs 8.

FIG. 7 is another tabulation of actual measurement values when a pressure of different value is used to form each of outer core legs 8, inner core leg 9 and back yoke 10 in an attempt to obtain an initial permeability μi of about 100 and a core-loss value of about 690 kW/$m^3$ after first split magnetic core 11 and second split magnetic core 12 are assembled together. The values shown in FIG. 7 are the results obtained under conditions set to approximate the initial permeability μi of 101 and the core loss of 695 kW/$m^3$, which are the values taken when the individual portions are formed with the pressure of 1,200 MPa among those measurement values shown in FIG. 6.

In FIG. 7, densities of the magnetic body in the individual portions, or outer core legs 8, inner core leg 9 and back yoke 10 are 6.65, 7.19 and 7.18 g/$cm^3$ respectively when the forming pressure is set to 600 MPa for outer core legs 8, and 1,600 Mpa for back yoke 10 and inner core leg 9. An initial permeability μi of 103 and a core loss of 692 kW/$m^3$ are taken after first split magnetic core 11 and second split magnetic core 12 are assembled. With regard to the usable life of the forming die, the parts corresponding to outer core legs 8 show about 320,000 shots, which is not inferior as compared with 580,000 shots and 510,000 shots for inner core leg 9 and back yoke 10 respectively.

FIG. 8 is still another tabulation of actual measurement values taken with different conditions set to approximate and obtain similar measurement values (i.e., initial permeability μi of 101 and core loss of 695 kW/$m^3$). Values shown in parentheses in FIG. 7 and FIG. 8 are the values recorded when the individual portions are formed with the uniform pressure of 1,200 Mpa.

In FIG. 8, densities of the magnetic body in the individual portions, or outer core les 8, inner core leg 9 and back yoke 10 are 7.03, 7.13 and 7.13 g/$cm^3$ respectively when the forming pressure is set to 1,000 MPa for outer core legs 8, and 1,400 Mpa for back yoke 10 and inner core leg 9. An initial permeability μi of 105 and a core loss of 685 kW/$m^3$ are taken after first split magnetic core 11 and second split magnetic core 12 are assembled. With regard to the usable life of the forming die, the parts corresponding to outer core legs 8 show about 60,000 shots, and those corresponding to inner core leg 9 and back yoke 10 show 660,000 shots and 580,000 shots respectively.

As shown in FIG. 7 or FIG. 8, it is possible to make adjustment to obtain magnetic properties of the desired values such as initial permeability μi, etc. with first split magnetic core 11 and second split magnetic core 12 assembled together, even when different forming pressures are used for outer core legs 8, inner core leg 9 and back yoke 10 to make the individual portions intentionally unequal in their densities of the magnetic body. It is possible to prolong the usable life of the forming die by reducing the forming pressure of outer core legs 8 having the smaller sectional area in the direction perpendicular to the direction of stroke as compared to the forming pressure applied to the other portions, to thereby decrease the density of the magnetic body.

In particular, a sufficiently large effect can be achieved to improve the usable life of the forming die (approximately two times) by making the density of the magnetic body of outer core legs 8 smaller than those of inner core leg 9 and back yoke 10 even though it is only about 1 to 2%, as shown in FIG. 8.

Figure 9:
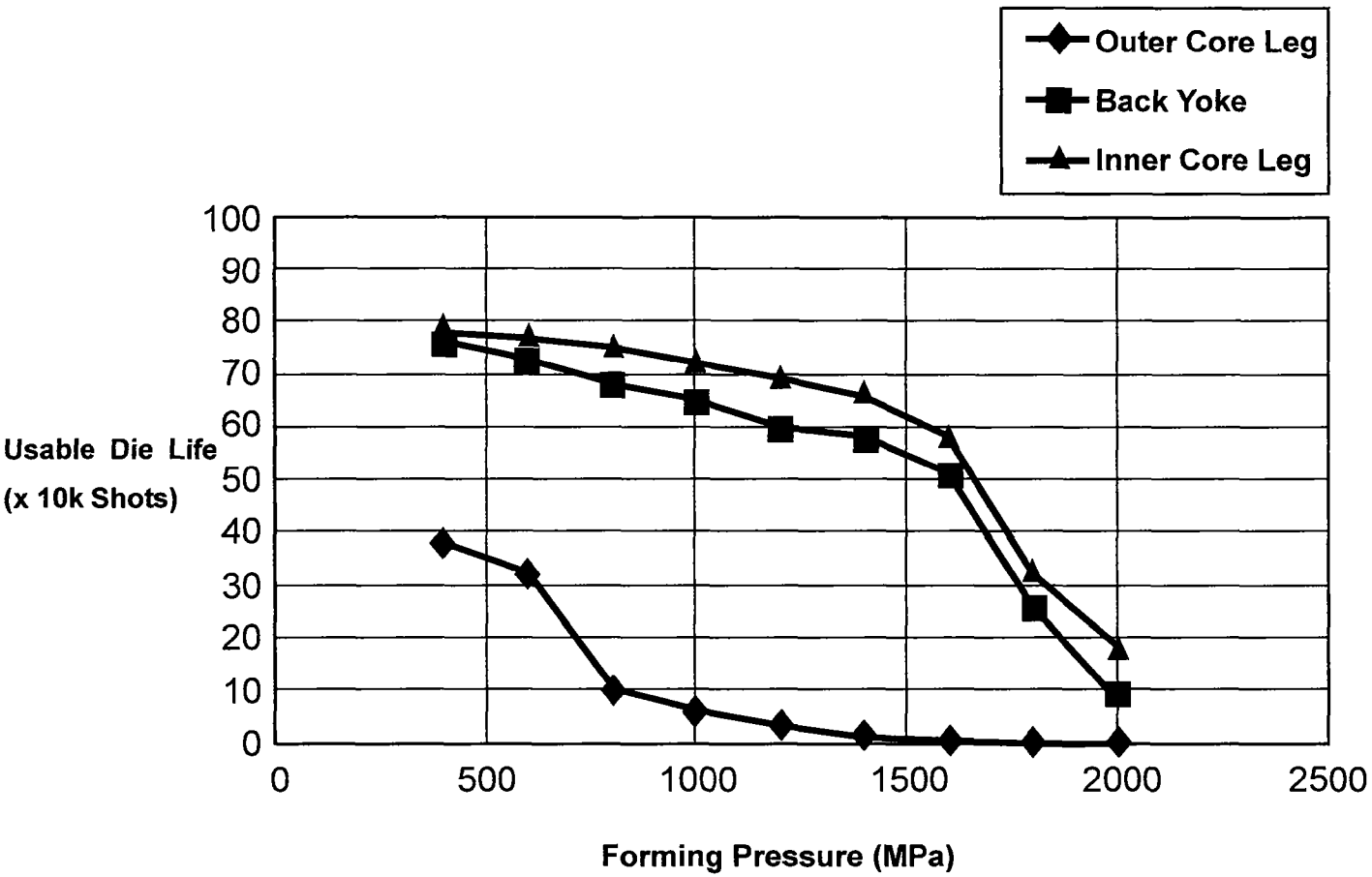
FIG. 9 is a graphic representation showing relations between forming pressure for each of the outer core leg, inner core leg and back yoke and usable life of the forming die when a permalloy-base dust core is used as a magnetic body.

FIG. 9 is a graphic representation showing relations between forming pressures for each of outer core legs 8, inner core leg 9 and back yoke 10 and usable life of the forming die when a permalloy-base magnetic material (dust core) is used as the magnetic body.

As shown in FIG. 9, the usable life of the forming die can be prolonged and the cost associated with it can be reduced by evading both of a curving area (i.e., the area below 1,400 Mpa in this case) where the life of parts of the die corresponding to outer core legs 8 for forming thin wall portions starts increasing and another curving area (i.e., the area above 1,600 Mpa in this case) where the life of other parts of the die corresponding to inner core leg 9 and back yoke 10 for forming thick wall portions starts decreasing.

The permalloy-base magnetic material used here as a magnetic material is in a granulated form produced by mixing 100 wt % of soft magnetic powder of FeNi alloy (50 wt % of Ni and remaining portion of Fe) having a mean diameter of 20 μm made by the water atomization method and 2.0 wt % of organic silicone resin.

In the example discussed above, the actual measurement values were taken on the samples of split magnetic core having the upper surface area of 25 mm square. However, this example should not be construed as restricting the scope of the present invention, such that this embodiment is to achieve a reduction in volume of the magnetic core and downsizing of the coil component by forming a portion of it corresponding to the thin wall part of the forming die with a low forming pressure to obtain the formed product of low density, and another portion of it corresponding to the thick wall portion of the forming die with a high forming pressure to obtain the formed product of high density. This can prevent the forming die from being damaged or buckled down in addition to lessening constraints related to the die for forming the magnetic core and a configuration of the magnetic core, thereby achieving a reduction of the cost by virtue of prolonging the durable life of the forming die.

Referring to the accompanying drawings, description is provided next of another example of forming first split magnetic core 11 and second split magnetic core 12 of the shape shown in FIG. 1 and FIG. 2 into a size of 25 mm square by using a sendust-base magnetic material.

FIG. 10 is a tabulation of actual measurement values showing densities of the magnetic body in individual portions, magnetic properties and useable lives of individual parts of the forming die in relation to forming pressures when the individual portions are uniformly formed by using a sendust-base magnetic material according to this exemplary embodiment of the invention.

In FIG. 10, a density of the magnetic body of 5.68 g/cm$^3$ is recorded for all of the individual portions of outer core legs 8, inner core leg 9 and back yoke 10 when the forming pressure is set to 1,200 Mpa, for instance. An initial permeability μi of 45 and a core loss of 580 kW/m$^3$ are taken after first split magnetic core 11 and second split magnetic core 12 are assembled. With regard to the usable life of the forming die, a part corresponding to outer core leg 8 shows about 20,000 shots, which is an extremely small number as compared with 600,000 shots and 560,000 shots for inner core leg 9 and back yoke 10 respectively.

FIG. 11 is another tabulation of actual measurement values when a pressure of different value is used to form each of outer core legs 8, inner core leg 9 and back yoke 10 in an attempt to obtain an initial permeability μi of about 45 and a core-loss value of about 580 kW/m$^3$ after the first split magnetic core and the second split magnetic core made of the sendust-base magnetic material are assembled together. FIG. 11 shows the results obtained under conditions set to approximate the initial permeability μi of 45 and the core loss of 580 kW/m$^3$, which are the values taken when the individual portions are formed uniformly with the forming pressure of 1,200 MPa among those measurement values shown in FIG. 10.

In FIG. 11, densities of the magnetic body in the individual portions, or outer core legs 8, inner core leg 9 and back yoke 10 are 5.39, 5.80 and 5.80 g/cm$^3$ respectively when the forming pressure is set to 600 MPa for outer core legs 8, and 1,600 Mpa for back yoke 10 and inner core leg 9. An initial permeability μi of 46 and a core loss of 564 kW/m$^3$ are taken after first split magnetic core 11 and second split magnetic core 12 are assembled. With regard to the usable life of the forming die, the parts corresponding to outer core legs 8 show about 290,000 shots, which is not inferior as compared with 550,000 shots and 480,000 shots for inner core leg 9 and back yoke 10 respectively.

FIG. 12 is still another tabulation of actual measurement values taken with different conditions set to approximate and obtain similar measurement values (i.e., initial permeability μi of 45 and core loss of 580 kW/m$^3$).

In FIG. 12, densities of the magnetic body in the individual portions, or outer core legs 8, inner core leg 9 and back yoke 10 are 5.61, 5.74 and 5.74 g/cm$^3$ respectively when the forming pressure is set to 1,000 MPa for outer core legs 8, and 1,400 Mpa for back yoke 10 and inner core leg 9. An initial permeability μi of 48 and a core loss of 560 kW/m$^3$ are taken after first split magnetic core 11 and second split magnetic core 12 are assembled. With regard to the usable life of the forming die, the parts corresponding to outer core legs 8 show about 50,000 shots, and those corresponding to inner core leg 9 and back yoke 10 show 580,000 shots and 530,000 shots respectively.

In FIG. 11 and FIG. 12, forming pressures of different values are used for outer core legs 8, inner core leg 9 and back yoke 10 to make the individual portions intentionally unequal in their densities of the magnetic body by using the sendust-base magnetic material. An adjustment is made on top of that to obtain magnetic properties of the desired values such as initial permeability μi, etc. with first split magnetic core 11 and second split magnetic core 12 assembled together. It is possible even in this example to prolong the usable life of the forming die by reducing the forming pressure of outer core legs 8 having the smaller sectional area in the direction perpendicular to the direction of stroke as compared to the forming pressure applied to the other portions to thereby decrease the density of the magnetic body.

In particular, a sufficiently large effect can be achieved to improve the usable life of the forming die (2.5 times) by making the density of the magnetic body of outer core legs 8 smaller than those of inner core leg 9 and back yoke 10 even though it is only about 1 to 2%, as shown in FIG. 12.

Figure 13:
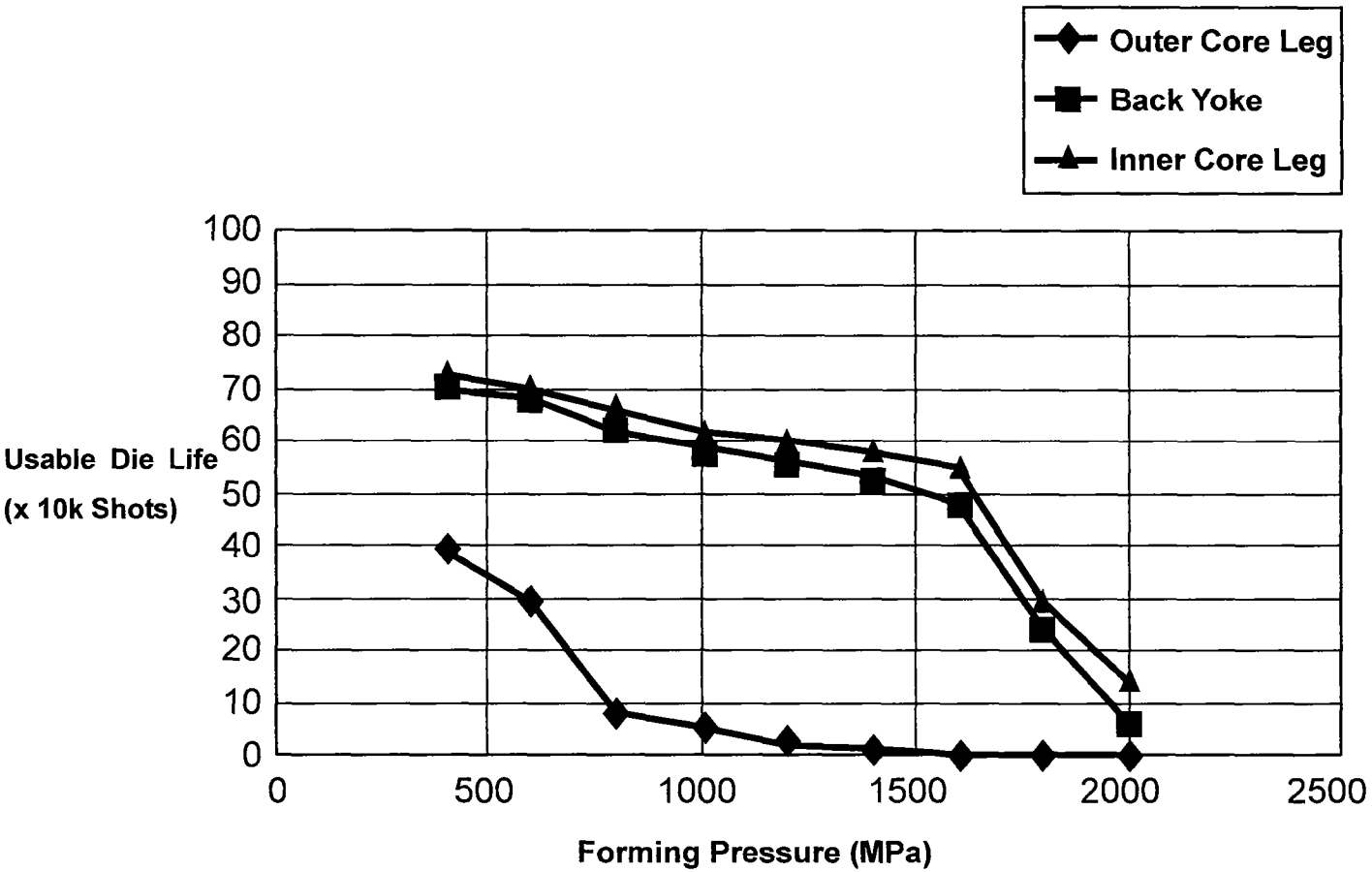
FIG. 13 is a graphic representation showing relations between forming pressure for each of the outer core leg, inner core leg and back yoke and usable life of the forming die when a sendust-base dust core is used as a magnetic body.

FIG. 13 is a graphic representation showing relations between forming pressure for each of outer core legs 8, inner core leg 9 and back yoke 10 and usable life of the forming die when a sendust-base dust core is used as the magnetic body.

As shown in FIG. 13, it is also possible in this example to prolong the usable life of the forming die and to reduce the cost associated with it by evading both of a curving area (i.e., the area below 1,400 Mpa in this case) where the life of a part of the die corresponding to outer core legs 8 for forming thin wall portions starts increasing and another curving area (i.e., the area above 1,600 Mpa in this case) where the life of other parts of the die corresponding to inner core leg 9 and back yoke 10 for forming thick wall portions starts decreasing.

The sendust-base magnetic material used here as a magnetic material is in a granulated form produced by mixing 100 wt % of FeAlSi alloy (6.0 wt % of Al, 8.5 wt % of Si and remaining portion of Fe) having a mean diameter of 20 μm made by the water atomization method and 2.0 wt % of organic silicone resin.

According to a study, the previously discussed relation of the wall thickness and surface area of the forming die and the forming pressure and the resulting forming density becomes applicable when a metal-base dust core (core made of magnetic powder) is used as the magnetic material. It should be understood that the dimensions discusses above are also illustrative and not restrictive.

When any of a weight ratio of the organic silicone resin and a kind of the resin material is changed among those magnetic materials, the densities of the magnetic body in the individual portions also change naturally. In any such case, the initial permeability (μi) is adjusted by setting outer core legs 8 to a comparatively low density while setting inner core leg 9 and back yoke 10 to a comparatively high density.

Figure 14:
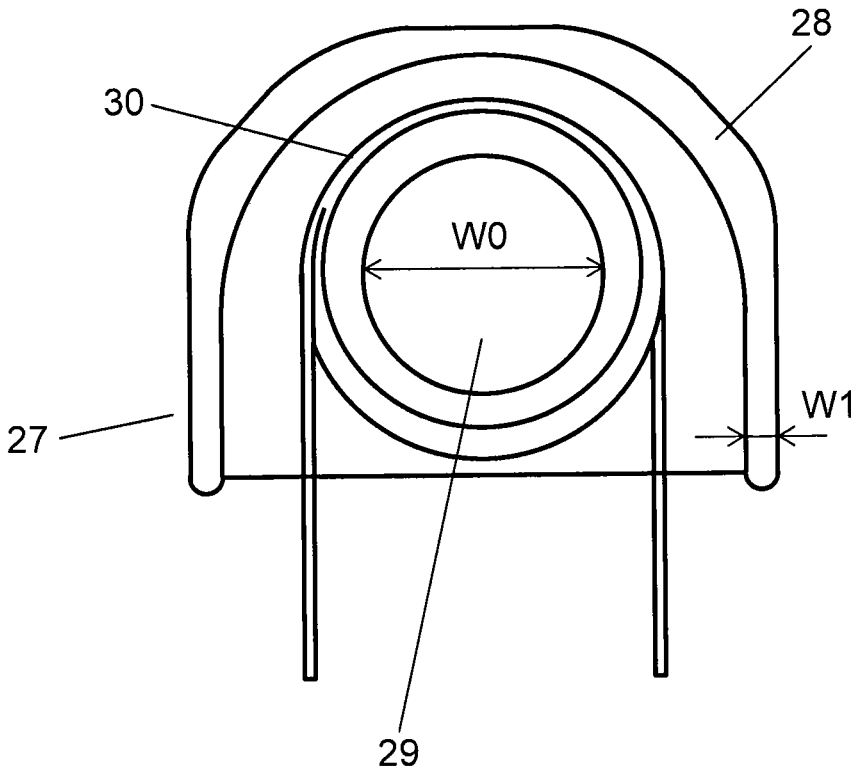
FIG. 14 is a top view showing still another example of a split magnetic core according to the exemplary embodiment of this invention.

Description is provided next of still another example of the split magnetic core. FIG. 14 is a top view showing this example of the split magnetic core according to this exemplary embodiment of the invention.

In the example shown in FIG. 14, split magnetic core 27 is so formed as to have outer core leg 28 of a single continuous shape rather than separated to the right and the left sides. In addition, outer core leg 28 is formed to have a thinner dimension of W1 as compared to a width dimension or a diameter W0 of inner core leg 29. In split magnetic core 27, outer core leg 28 is thus provided in a manner to surround inner core leg 29 and coil block 30 except for one portion.

In the viewpoint of magnetic saturation it is necessary to make a sectional area of inner core leg 29 at least equal to or larger than that of outer core leg 28 since magnetic flux generated by coil block 30 placed around the periphery of inner core leg 29 flows from inner core leg 29 to outer core leg 28 when two split magnetic cores 27 are butted against each other. In addition, outer core leg 28 is likely to require a complex shape and a thin dimension as compared to inner core leg 29 because outer core leg 28 is shaped to surround inner core leg 29.

That is, in the case of split magnetic core 27, at least a part of outer core leg 28 is formed to have the inner periphery of a shape facing along the outer periphery of inner core leg 29, and the thickness of outer core leg 28 is set equal to or below the diameter of inner core leg 29. This requires the forming die for forming split magnetic core 27 to have such a configuration that a part of it corresponding to outer core leg 28 becomes complex in shape or small in size with a thin wall and curvatures at a plurality of portions, which makes the forming die physically vulnerable.

To this end, the magnetic body in outer core leg 28 is formed lower in density than that of the magnetic body in inner core leg 9, so as to help lower the pressure required for the forming die to form the portion of lower density. In other words, a comparatively higher pressure is applied to a part of the forming die having a larger sectional area where wearing is not likely to progress easily whereas the pressure is reduced to relatively low for the part having a smaller sectional area where wearing is likely to progress quickly, so as to retard the progress of wear. The configuration thus adopted for the forming die keeps evenness in the degree of wearing of the forming die as a whole. Accordingly, the usable life of the forming die is made to be dependent on the part having the larger sectional area where wearing is unlikely to progress. As a result, it helps prolong the usable life of the forming die, and achieve a reduction of the cost related to the forming die. It also makes possible, as a consequence to provide split magnetic core 27 having a complex shape.

Figure 15B:
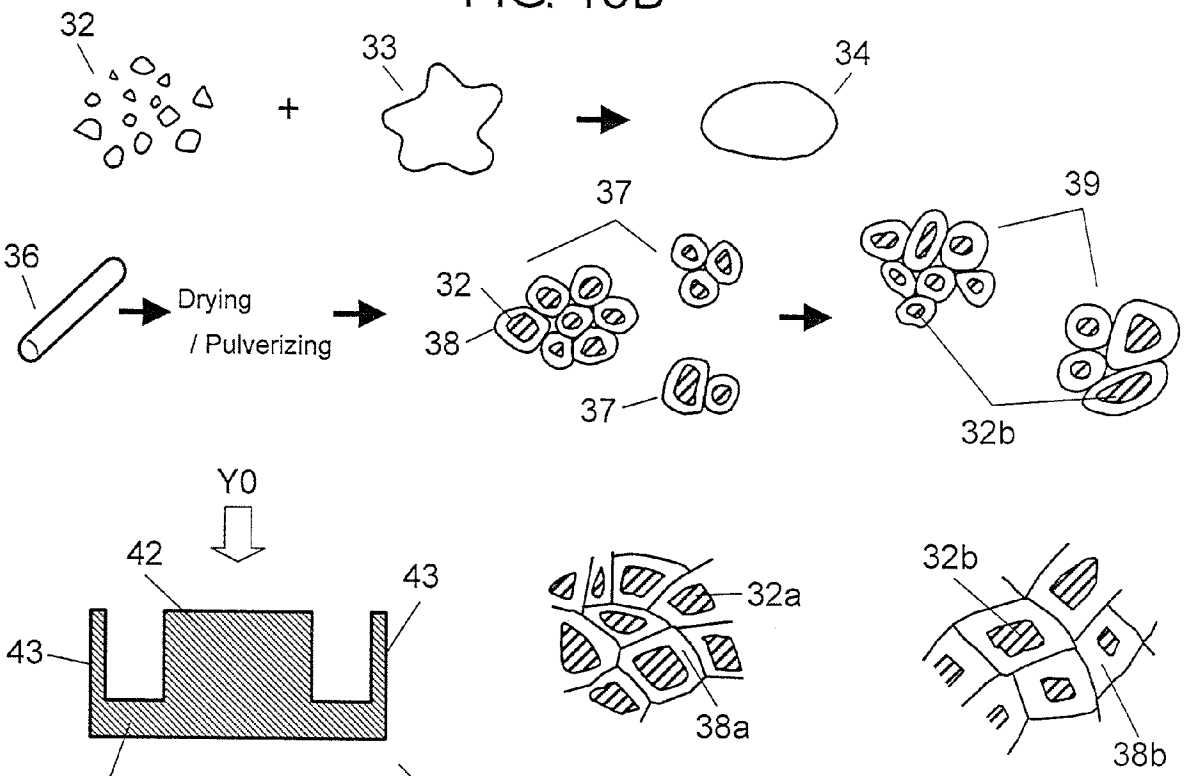
FIG. 15B is a schematic illustration from the process of forming the magnetic body constituting the split magnetic core to the completion of the coil component according to the exemplary embodiment of this invention.
Figure 15A:
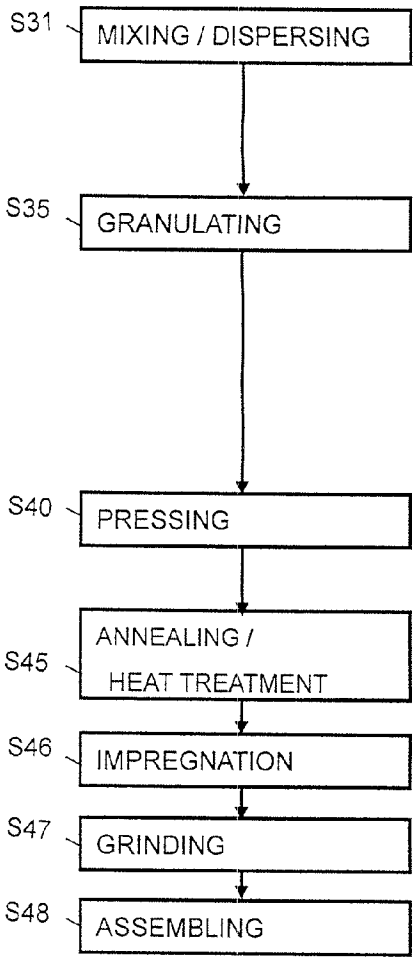
FIG. 15A is a flow diagram from the process of forming a magnetic body constituting a split magnetic core to the completion of a coil component according to the exemplary embodiment of this invention.
Figure 16:
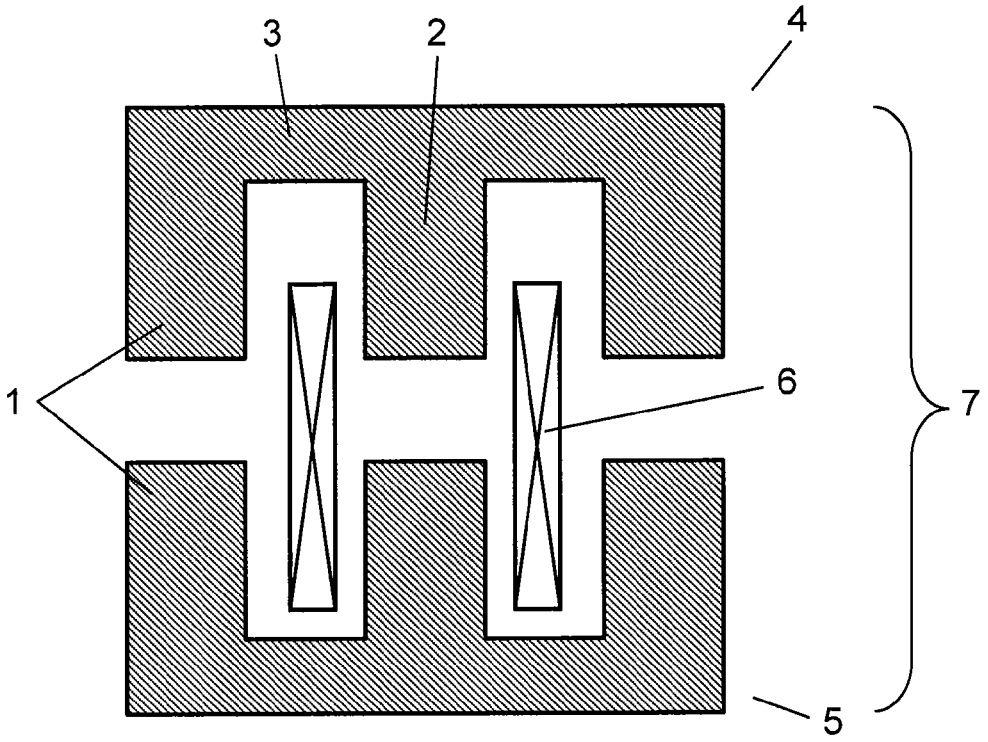
FIG. 16 PRIOR ART
FIG. 16 is a sectional view of a conventional coil component.
Figure 17:
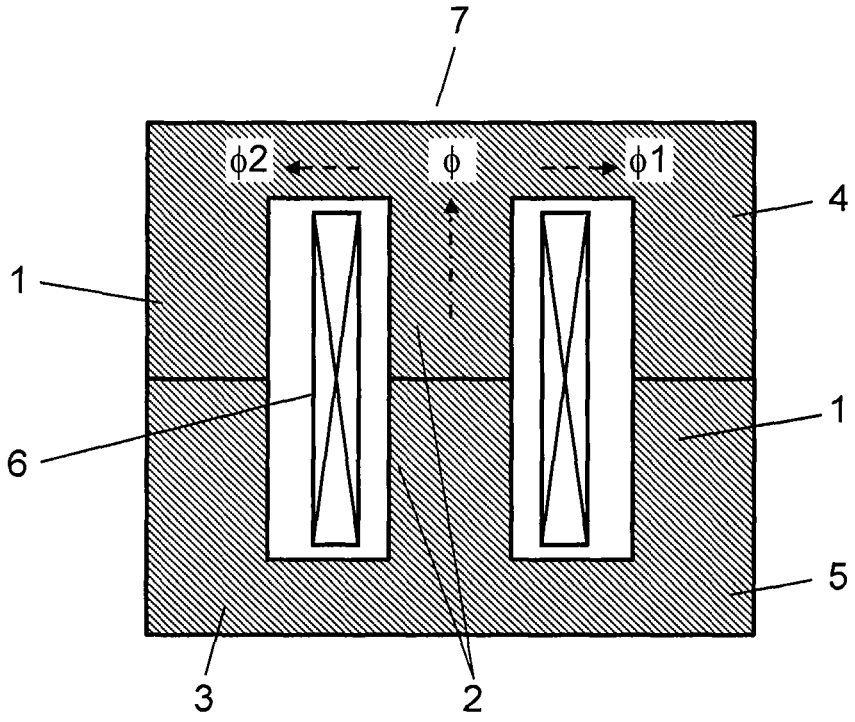
FIG. 17 PRIOR ART
FIG. 17 is a sectional view of the conventional coil component in a configuration showing a first split magnetic core and a second split magnetic core butted against each other.
Figure 18:
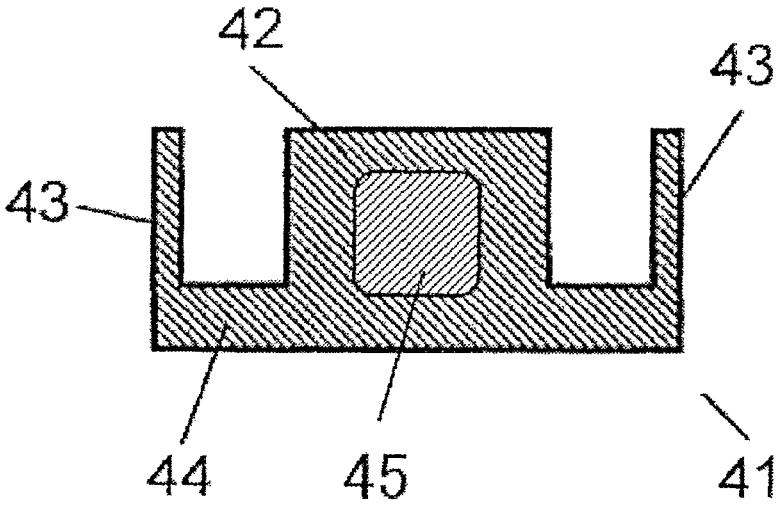
FIG. 18 is a sectional view of the coil component illustrating the interior area of the inner core leg according to the exemplary embodiment.

Description provided next pertains to a method of manufacturing a coil component, including a method of forming a magnetic body used to compose any of first split magnetic core 11 and second split magnetic core 12 shown in FIG. 1 and FIG. 2, first split magnetic core 18 shown in FIG. 3, split magnetic core 27 shown in FIG. 14, and the like. FIGS. 15A and 15B are a flow diagram and a schematic illustration from the process of forming a magnetic body constituting a split magnetic core to the completion of the coil component according to this exemplary embodiment of the invention, wherein FIG. 15A shows the flow diagram, and FIG. 15B shows the schematic illustration of individual processes in FIG. 15A.

As the first step, a mixing and dispersing process is carried out. In the mixing and dispersing process, magnetic metal powder 32 consisting of powdery particles of various sizes is mixed together with resin 33 containing a solvent to prepare mixture 34 of a clay form (Step S31).

Next, a granulating process is carried out as the second step. In this granulating process, mixture 34 prepared in the mixing and dispersing process (Step S31) is packed into a lump of predetermined shape such as cylindrical solid 36, and it is dried to remove the solvent originally contained in mixture 34. Cylindrical solid 36 is pulverized thereafter to obtain solid particle 37. The solid particle 37 formed here is an aggregation of a plurality of powder of varying sizes, each having magnetic metal powder 32 covered by resin film 38 of generally a uniform thickness. A mass of solid particle 37 is then classified to obtain granulated powder 39 having particle sizes limited to any desired range (Step S35).

In the example shown in FIGS. 15A and 15B, the second step is described as the process of obtaining granulated powder 39 from mixture 34 prepared in the first step. However, the scope of the present invention does not set any limit to this process, but the invention may be practiced in still other ways such that the first step of mixing and dispersing process and the second step of granulating process can be executed simultaneously by atomizing resin 33 containing a solvent, and coating it around magnetic metal powder 32.

A pressing process is carried out next as the third step. The pressing process is the main process including the methods hitherto detailed in this description, and it is the step of pressure forming granulated powder 39 produced in the granulating process 35 with a forming die (not shown) to make a formed product of the desired shape (Step S40).

In this pressing process, a pressure is applied in the directions of arrows Y0 and Y1 (i.e., the direction of thickness of split magnetic core 41) shown in FIGS. 15A and 15B when forming the formed product such as split magnetic core 41. The pressure forming is carried out in a manner that a high pressure is applied to thick wall portion 42 and connecting portion 44 having comparatively large areas, and a low pressure is applied to thin wall portion 43 having a comparatively small area, as they are viewed in the directions of arrows Y0 and Y1. Thick wall portion 42, thin wall portion 43 and connecting portion 44 comprise an inner core leg, an outer core leg and a back yoke respectively.

It thus becomes possible to form thick wall portion 42 and connecting portion 44 to be the high density portions of granulated powder 39, magnetic metal powder 32 or the like magnetic body, and thin wall portion 43 to be the low density portion of granulated powder 39, magnetic metal powder 32 or the like magnetic body, so that thin wall portion 43 has a density lower than that of thick wall portion 42 and connecting portion 44.

In this process here, the reason of pressure forming thick wall portion 42 and connecting portion 44 with a comparatively high pressure, and thin wall portion 43 with a comparatively low pressure is a result of consideration given to the usable life of the forming die, as discussed in the foregoing. The pressure forming carried out in the above manner pressurizes granulated powder 39 into a heavily dense condition, and compresses resin films 38*a* considerably to bring magnetic metal powder 32*a* close to one another tightly inside thick wall portion 42 and connecting portion 44 of split magnetic core 41 having the high density.

In the case of thin wall portion 43 formed under the condition of lower pressure than those of thick wall portion 42 and connecting portion 44, on the other hand, resin films 38*b* are compressed to a level comparatively lower than those of thick wall portion 42 and connecting portion 44, and magnetic metal powder 32*a* is scattered sparsely inside.

In the example shown in FIGS. 15A and 15B, split magnetic core 41 is illustrated as having a shape of the letter E. However, this embodiment does not set a limit to this shape when this process is applied.

Following the pressing process, an annealing/heat treatment process is carried out as the fourth step. The formed product prepared in the pressing process is thermally treated at a high temperature in this process (Step S45). This heat treatment removes resin films 38*a* and 38*b* from thick wall portion 42, thin wall portion 43 and connecting portion 44 of split magnetic core 41.

The annealing/heat treatment process produces inorganic substances (not shown) between individual magnetic metal powder 32*a* and 32*b*. These inorganic substances mechanically couple magnetic metal powder 32*a* and 32*b* while keeping their positions of non-contact state, so as to maintain their relative positions that help reduce an eddy current loss attributable to an eddy current generated in the surfaces of magnetic metal powder 32*a* and 32*b* during the presence of magnetic flux.

Thick wall portion 42, thin wall portion 43 and connecting portion 44 constituting the formed product of split magnetic core 41 in a state of low mechanical strength even though they maintain their shapes. The annealing/heat treatment process works, at the same time, to reduce a hysteresis loss by removing stresses exerted on magnetic metal powder 32*a* and 32*b* during the pressure forming in the pressing process.

Next, an impregnation process is carried out as the fifth step. In the impregnation process, the formed product of split magnetic core 41 that has undergone the annealing and heat treatment in the annealing/heat treatment process is impregnated with a resin material (Step S46).

In the pressing process, thick wall portion 42 and connecting portion 44 are formed with the comparatively high pressure, and thin wall portion 43 with the comparatively low pressure. This process leaves a difference to exist between a strength of mechanical coupling among magnetic metal powder 32*a* inside thick wall portion 42 and connecting portion 44 and another strength of mechanical coupling among magnetic metal powder 32*b* inside thin wall portion 43. This means that the mechanical strength differs from one portion to another even within the single formed product of split magnetic core 41.

When split magnetic core 41 is once subjected to the heat treatment in the annealing/heat treatment process and resin films 38*a* and 38*b* removed, it comes into a state of having the coupling strength weakened. The impregnation process is to impregnate and inject an impregnation resin into spaces around the individual magnetic metal powder 32*a* and 32*b* of the split magnetic core 41. After this process, the impregnation resin is hardened to improve the mechanical strength of the formed product by virtue of the coupling force of the impregnation resin after it is hardened.

The coupling force of the impregnation resin after hardened is very high as compared with a coupling force imparted by compression of the forming during the pressing process. As a result, the coupling force of the impregnation resin after hardened becomes predominant in the mechanical strength of the formed product. When comparison is made in view of the strength per unit volume of the impregnation resin after hardened between thick wall portion 42 and connecting portion 44 having a high density of magnetic metal powder 32*a* and thin wall portion 43 having a low density of magnetic metal powder 32*b*, a larger amount of the impregnation resin is found infiltrated into thin wall portion 43 than thick wall portion 42 and connecting portion 44. This can hence increase the strength per unit volume of thin wall portion 43 larger than those of thick wall portion 42 and connecting portion 44 after the hardening.

Accordingly, the mechanical strengths of the individual portions can be brought close to one another by increasing the thickness and dimensions of portions of low strength and decreasing the thickness and dimensions of other portions of high strength among thick wall portion 42, connecting portion 44 and thin wall portion 43 having differences in their absolute volumes and dimensions. As a result, split magnetic core 41 having a reliable strength can be obtained consequently upon making different densities of magnetic metal powder 32*a* and 32*b* in the individual portions of the formed product.

In the process of making the entire split magnetic core 41 completely impregnated by letting the impregnation resin infiltrate throughout the internal spaces of both of thick wall portion 42 and connecting portion 44 as well as thin wall portion 43, a time required to completely impregnate the both of thick wall portion 42 and connecting portion 44 comes to be longer than a time required to completely impregnate thin wall portion 43.

It is therefore proper to provide the time only needed to fully impregnate thin wall portion 43, and make the impregnation of thick wall portion 42 and connecting portion 44 limited to their surface side while the interior areas 45 are left impregnated incompletely such that a degree of the impregnation in thick wall portion 42 and connecting portion 44 becomes less toward the deep center from the surface side of them.

In this instance, a surface area of thick wall portion 42 is larger than an individual surface area of thin wall portion 43, and the impregnation resin is made to exist in a cylindrical form along the surface. In addition, a surface area of connecting portion 44 is also larger than the individual surface area of thin wall portion 43, and the impregnation is spread nearly evenly without irregularity, since the magnetic body is formed uniformly in the density. This results in any of thick wall portion 42 and connecting portion 44 to have a larger volume of the impregnated area than a volume of the impregnated area of thin wall portion 43 even though the interiors of thick wall portion 42 and connecting portion 44 are not impregnated completely.

In the case of leaving the interior side of thick wall portion 42 and connecting portion 44 not impregnated completely by having the impregnation process limited only to the surface side, there is not a significant difference in the strength of the impregnation resin after hardened when compared to the case the impregnation is made completely. Therefore, the mechanical strengths after hardened can be set nearly equivalent for all of thick wall portion 42, connecting portion 44 and thin wall portion 43 even if the shortest of required time is chosen for the degree of hardening amongst thick wall portion 42, connecting portion 44 and thin wall portion 43.

In the above example, although the time provided for impregnation of split magnetic core 41 is selected to generally correspond to the time required to completely impregnate thin wall portion 43, a mechanical strength after hardening of nearly equivalent value as those of thick wall portion 42 and connecting portion 44 can be obtained for thin wall portion 43 when impregnation is carried out simultaneously, even if the impregnation of thin wall portion 43 is made incompletely to only its surface area.

Accordingly, a well-balanced mechanical strength can be achieved throughout the individual portions of thick wall portion 42, thin wall portion 43 and connecting portion 44 while reducing the time needed for the impregnation by way of carrying out the impregnation of the resin simultaneously into all of thick wall portion 42, connecting portion 44 and thin wall portion 43 for obtaining a minimum level of the mechanical strength.

A grinding process is carried out next as the sixth step following the impregnation process. In the grinding process, surfaces, especially those areas of the surfaces to be butted upon each other of split magnetic cores 41 are ground after they are impregnated with the impregnation resin and hardened in the impregnation process (Step S47).

An assembling process is carried out as the subsequent seventh step. This assembling process is to complete coil component 14 by combining and fixing first split magnetic core 11 and second split magnetic core 12 with coil block 13 placed between them, for instance as shown in FIG. 1 (Step S48).

With a series of the processes described above, the densities of the magnetic body can be varied amongst the individual portions of first split magnetic core 11 and second split magnetic core 12 so as to reduce the volume and the sectional area of outer core leg 8 in comparison with inner core leg 9 and back yoke 10. Thus achieved is a coil component having the desired characteristics in addition to downsizing first split magnetic core 11 and second split magnetic core 12 to the minimum required volume.

Furthermore, the above processes can prolong the usable life of the forming die for first split magnetic core 11 and second split magnetic core 12. In addition, the processes can also help obtain the mechanical strength while maintaining balancing over the individual portions in first split magnetic core 11 and second split magnetic core 12.

INDUSTRIAL APPLICABILITY

As described in the foregoing, the present invention is useful for coil components employed in various electronic apparatuses, a method of manufacturing the same and the like, since the invention can provide the coil components having magnetic cores that help achieve a cost reduction by reducing constraints on shapes of a forming die and the coil, downsizing, preventing damages and buckling of the forming die, and thereby prolonging the durable life of the forming die.

REFERENCE MARKS IN THE DRAWINGS

8, 15, 21, 24, 28 Outer core leg
9, 16, 22, 23, 29 Inner core leg
10, 17, 25 Back yoke
11, 18 First split magnetic core
12, 19 Second split magnetic core
13, 30 Coil block
14, 54, 64 Coil component
26, 41, 55 Split magnetic core
32, 32*a*, 32*b* Magnetic metal powder
33 Resin
34 Mixture
36 Cylindrical solid
37 Solid particle
38 Resin film
39 Granulated powder
42 Thick wall portion
43 Thin wall portion
44 Connecting portion

The invention claimed is:

1. A coil component comprising:

a magnetic core having an outer core leg, an inner core leg and a back yoke connecting the outer core leg and the inner core leg, each of the outer core leg, the inner core leg and the back yoke including a magnetic body formed of magnetic powder; and a coil block mounted to the inner core leg, wherein:

the inner core leg includes an interior area in which resin is not fully impregnated, a density of the magnetic metal powder in the outer core leg is different from both of a density of the magnetic metal powder in the inner core leg and a density of the magnetic metal powder in the back yoke, and the inner core leg is formed in a substantially uniform distribution of the density.

2. The coil component of claim 1, wherein the magnetic core having a first split magnetic core and a second split magnetic core, and the outer core leg, the inner core leg and the back yoke are included in the first split magnetic core, and the second split magnetic core is formed in a rod-like shape of a plate-like shape, and the first split magnetic core and the second split magnetic core are butted against each other to form the magnetic core of a closed magnetic circuit.

3. The coil component of claim 1, wherein the density of the magnetic metal powder in the back yoke is formed substantially equal to the density of the magnetic metal powder in the inner core leg, and the magnetic body in the back yoke is formed uniform in distribution of the density.

4. The coil component of claim 1, wherein the density of the magnetic metal powder in the back yoke is formed higher than the density of the magnetic metal powder in the inner core leg, and the magnetic body in the back yoke is formed uniform in distribution of the density.

5. The coil component of claim 1, wherein a dimension of a smallest width portion in sectional area of the outer core leg is smaller than a dimension of a smallest width portion in sectional area of the inner core leg.

6. The coil component of claim 1, wherein the magnetic body contains a resin.

7. The coil component of claim 1, wherein the first split magnetic core and the second split magnetic core are formed by impregnating the magnetic body.

8. The coil component of claim 2, wherein the density of the magnetic metal powder in the back yoke is formed substantially equal to the density of the magnetic metal powder in the inner core leg, and the magnetic body in the back yoke is formed uniform in distribution of the density.

9. The coil component of claim 2, wherein the density of the magnetic metal powder in the back yoke is formed higher than the density of the magnetic metal powder in the inner core leg, and the magnetic body in the back yoke is formed uniform in distribution of the density.

10. The coil component of claim 2, wherein a dimension of a smallest width portion in sectional area of the outer core leg is smaller than a dimension of a smallest width portion in sectional area of the inner core leg.

11. The coil component of claim 2, wherein the magnetic body contains a resin.

12. The coil component of claim 2, wherein the first split magnetic core and the second split magnetic core are formed by impregnating the magnetic body.

13. The coil component of claim 1, wherein the outer core leg is formed in substantially uniform distribution of the density.

14. The coil component of claim 1, wherein the magnetic core having a first split magnetic core and a second split magnetic core, and the outer core leg, the inner core leg and the back yoke are included in each of the first split magnetic core and the second split magnetic core, and the first split magnetic core and the second split magnetic core are butted against each other to form the magnetic core of a closed magnetic circuit.

15. The coil component of claim 1, wherein the inner core leg has two end portions which are disposed equidistant from a center of the coil component, and the inner core leg is formed in a substantially uniform distribution of the density between the two end portions.

16. The coil component of claim 1, wherein the magnetic metal powder in the outer core leg, the magnetic metal powder in the outer core leg and the magnetic metal powder in the back yoke are a same magnetic metal powder.

* * * * *